US006176792B1

(12) United States Patent
Tate

(10) Patent No.: US 6,176,792 B1
(45) Date of Patent: Jan. 23, 2001

(54) DIVOT REPAIR TOOL/GOLF PRACTICE AID

(76) Inventor: John R. Tate, 11621 Markon Dr., Garden Grove, CA (US) 92841

( * ) Notice: Under 35 U.S.C. 154(b), the term of this patent shall be extended for 0 days.

(21) Appl. No.: 09/395,282

(22) Filed: Sep. 13, 1999

(51) Int. Cl.[7] ..... A63B 57/00
(52) U.S. Cl. ..... 473/286; 473/408
(58) Field of Search ..... 473/408, 286, 473/340, 341, 349; D21/793

(56) References Cited

U.S. PATENT DOCUMENTS

| | | | | |
|---|---|---|---|---|
| D. 422,664 | * | 4/2000 | Tate | D21/793 |
| 3,185,483 | * | 5/1965 | Klynman | 473/286 |
| 4,240,636 | * | 12/1980 | Swenson | 473/340 |
| 5,121,519 | * | 6/1992 | Haugom | 473/408 |
| 5,733,208 | * | 3/1998 | Fazekas | 473/408 |
| 5,997,411 | * | 12/1999 | Holub | 473/408 |

* cited by examiner

*Primary Examiner*—Steven Wong
(74) *Attorney, Agent, or Firm*—Charles H. Thomas

(57) ABSTRACT

A golf divot repair tool is combined with a golf putter club head in such a way as to provide a golfer with a golf putting practice aid that may be easily and conveniently utilized while the golfer engages in a round of golf. Typically, the putting aid of the invention can be utilized by a golfer awaiting his or her turn to putt at a golf green. A divot repair tool is configured as a small, narrow, thin, elongated, flat structure that defines a longitudinal axis of lateral symmetry. The tool has a pair of longitudinally projecting legs at one end and a disc-shaped magnet embedded in its structure at the other end. A raised, transverse hump structure is defined on the tool between its ends. The hump is oriented perpendicular to the longitudinal axis of lateral symmetry. The raised, transverse hump serves as a stop that ensures proper alignment of the tool relative to the putter club head when the tool is positioned against the sole of the club head. If the club head is formed with a shelf on its back side, opposite the front ball-impact face, the tool can also be positioned atop the shelf and in abutment against the rear abutment structure rising upwardly from the shelf. A golfer can attach and align the tool relative to a golf putter head in an instant, and just as readily detach the tool from the putter head. The combination of the tool with the golf putter thereby serves as a very convenient, transportable, unburdensome practice aid that can be carried and utilized by a golfer while actually engaging in a round of golf.

19 Claims, 8 Drawing Sheets

DIVOT REPAIR TOOL/GOLF PRACTICE AID

BACKGROUND OF THE INVENTION

1. Field of the Invention

The present invention relates to a hand-held tool of the type utilized to repair crushed sod and grass scars and divots that sometimes are produced on the courses in the game of golf, and the deployment of such a tool in combination with a golf putter as an aid for putting practice.

2. Description of the Prior Art

During a round of golf quite frequently a golfer will arrive at a green in preparation for a golf putt, but will sometimes have to wait for several minutes for other golfers to complete their shots. During this time the golfer can contemplate the best way to execute the golf putt that is required to maximize the likelihood that the golfer's next putt will drop in the hole. In this connection it is often useful for the golfer to practice a proper putting stance, manner of addressing the ball, and swing of the golf putter club.

Many golfers have difficulty putting because the line of movement of the golf putter during the putting stroke is not precisely perpendicular to the face of the putter. As a consequence, when the plane of the impact face of the putter strikes the golf ball, it does so at a slight angle which will cause the ball to travel along a path at a slight angle to the plane of the putter stroke. Even a very slight error in this regard will result in a putt that travels to one side or the other of the cup.

Numerous putting aids exist which are designed to allow a golfer to improve putting strokes. However, conventional training aids involve devices which are too large or cumbersome to be carried along during the actual golf match. Rather, many conventional putting aids are designed for the golfer to utilize in private at a practice location, but not while awaiting a turn on the actual field of play.

SUMMARY OF THE INVENTION

The present invention involves the use of a small golf divot repair tool in combination with a golf putter as a practice aid to golfers for practicing putting. Golf divot repair tools of the type employed in the combination of the invention are widely utilized by golfers for sprucing up golf greens and divots that are created while playing a game of golf. These tools are small, hand-held devices that are provided with a body having a pair of legs extending longitudinally from one end of the tool. In conventional practice the golfer grasps the tool at the end opposite the legs and inserts the legs into a crushed area on the green, or even the fairway, to lift up the grass following a shot or step that damages an area of the green. Golf divot tools are manufactured in a variety of configurations, but are all used for the basic purpose of sprucing up golf greens. Virtually all golf divot repair tools that are sold commercially to any extent are quite small, and easily fit within the pocket or otherwise on the person of the golfer. Golf divot tools are easy to carry and are unobtrusive during use. Moreover, they represent no additional burden to a golfer in playing a course when used in the combination of the invention.

There are several unique features about the golf divot repair tool employed according to the present invention. Many golf divot repair tools are equipped with slabs of magnetic material that are permanently mounted in cavities in the tool in such a manner as to receive a ball marker formed of a ferrous material atop the magnetic slab in the cavity. The divot repair tool of the present invention also employs a magnet, but of a different configuration and attached in a different location and for a different purpose as contrasted with a conventional golf divot repair tool.

Specifically, the golf divot repair tool of the invention has a magnet embedded in its structure at the end thereof opposite the longitudinally projecting legs. The magnet is embedded in such a way as to make direct contact with a planar surface placed against the surface of the tool at the end at which the magnet is located. The divot repair tool is preferably formed of a strip of magnetically insensitive material, such as a strip of aluminum, which includes a die cut circular opening at the end of the strip opposite the end at which the longitudinally projecting legs are formed on the tool. The die cut opening extends completely through the flat structure of the end of the tool opposite the legs.

A small, disc-shaped magnet is permanently secured in the circular opening formed in the end of the tool remote from the legs such that the flat, circular surfaces on both sides of the disc-shaped magnet reside in coplanar relationship with the surrounding surfaces of the end of the tool in which the magnet is embedded. As a consequence, the end of the tool in which the magnet is embedded can be placed flush against a flat ferrous surface that may be located either above or below the tool. The legs at the opposite end of the tool thereby serve as pointing indicia projecting outwardly from the surface to which the tool is magnetically attached.

The golf divot repair tool of the invention also includes a raised structure located between the end of the tool in which the longitudinally extending legs are formed and the opposite end of the tool in which the magnet is embedded. The alignment of this raised structure extends perpendicular to the longitudinal alignment of the tool. The raised, hump-shaped structure between the ends of the tool is useful for positioning the tool in such a manner that the legs of the tool project straight out from the putter head in a direction aligned along the proper path of movement of the putter head, or parallel to that path of movement.

The club head of the golf putter employed in the practice aid of the invention must be formed of a material attracted by magnetism, such as iron or steel. While some golf putter club heads are formed of brass or aluminum, the vast majority are made of steel, which is attracted by magnetism.

In one broad aspect the invention may be considered to be a golf putting training aid comprising in combination: a golf putter having a club head formed of a material attracted by magnetism and having a flat front ball-impact face, a sole extending rearwardly from the front ball-impact face, and a back including a central region that rises sharply upwardly from the sole at a linear demarcation therefrom that lies parallel to the front ball-impact face at an angle of at least forty-five degrees relative to the sole. The golf putting training aid is further comprised of a thin golf divot repair tool with a longitudinally elongated body defining a straight longitudinal axis of lateral symmetry having opposing ends and including a pair of longitudinally directed legs at one of the ends. A magnet is embedded in the other of the ends. A raised transverse structure is located between the ends and is oriented perpendicular to the longitudinal axis of symmetry. The golf divot repair tool is held against the club head by magnetic attraction between the magnet and the club head.

In one preferred manner of deployment the golf divot repair tool is held against the sole of the club head by magnetic attraction between magnet and the club head with the raised, transverse structure of the tool residing in abutment against the central region of the back of the club. Normally the divot repair tool will be aligned so that the longitudinal axis of lateral symmetry of the repair tool lies perpendicular to the front ball-impact face of the club head. The legs of the divot repair tool project rearwardly from the central region of the back of the club in a direction away from the ball-impact face.

In another preferred embodiment of the invention, the golf divot repair tool is held against the sole of the club head so that the legs of the divot repair tool project forwardly from the front ball-impact face. Normally the longitudinal axis of lateral symmetry of the repair tool lies perpendicular to the front ball-impact face of the club head when the divot repair tool is deployed in this manner as well.

The divot tool of the invention may be used in still other advantageous ways. In some golf putters, the golf putter head is formed with a back including a central region defining a planar shelf with a flat surface oriented perpendicular to the front face and parallel to the sole of the club head. A putter head so configured has a rear abutment face that extends up from the planar shelf at a linear demarcation therewith. The demarcation is parallel to the ball-impact face. The rear abutment face extends at an angle of at least forty-five degrees relative to the shelf. More typically, however, the rear abutment face is perpendicular to the shelf.

The golf putter putting training aid of the invention may be comprised of the combination of such a putter club head having the foregoing configuration and a thin golf divot repair tool with a longitudinally elongated body defining a straight, longitudinal axis of symmetry. The body of the tool has opposing ends and includes a pair of longitudinally directed legs at one of its ends. It has a magnet embedded in the other of its ends. The golf divot repair tool is held against the upwardly facing shelf of the club head by magnetic attraction between the magnet and the club head. The end of the divot repair tool bearing the magnet resides in contact with the rear abutment face at the linear demarcation between the rear abutment face and the shelf, so that the legs of the divot repair project rearwardly from the shelf in a direction away from the ball-impact face and along an alignment that is perpendicular to the ball-impact face.

In still another arrangement the invention may be comprised of the combination of a golf putter having a club head formed of a material attracted by magnetism and having a flat, front ball-impact face, a sole extending rearwardly from the impact face and oriented perpendicular thereto with a straight linear edge transition between the impact face and the sole, and at least one thin golf divot repair tool. The repair tool has a longitudinally elongated body defining a straight longitudinal axis of lateral symmetry. The body of the divot repair tool has opposing ends and includes a pair of longitudinally directed legs at one of the ends. A magnet is embedded in the other of the ends of the body. A raised, transverse structure is located between the ends of the body and is oriented perpendicular to the longitudinal axis of lateral symmetry. The golf divot repair tool is held against the sole of the club head by magnetic attraction between the magnet and the club head, with the raised transverse structure of the tool residing in abutment against the straight, linear edge transition. In this way the legs of the divot tool project forwardly from the ball-impact face.

For enhanced alignment purposes, it may be advantages for a pair of the divot tools configured as described to be employed. Both of the divot tools magnetically adhere to the club head with the raised, transverse structures thereof in abutment against the straight, linear edge transition between the flat, front ball-impact face and the sole of the club head. Where a pair of divot tools are employed in this matter, they are positioned at laterally spaced locations from each other. That is, one of the divot tools projects forwardly from the ball-impact face near the toe of the club head, while the other projects forwardly from the ball-impact face near the heel of the club head. This aids not only in aligning the flat, ball-impact face so that it lies perpendicular to the path of movement of the club head toward the ball while putting, but also aids the golfer is aligning the club head so that the exact center or "sweet spot" of the club face impacts against the ball as the putter club head strikes the ball.

In still another aspect the invention may be considered to be merely the golf divot repair tool by itself. The golf divot repair tool of the invention is formed as a thin, narrow strip of magnetically insensitive material of uniform thickness throughout and having a longitudinally elongated body. The body of the narrow strip defines a straight, longitudinal axis of lateral symmetry. That is, when viewed from directly above, the structure of the divot tool is formed of mirror image portions on either side of an imaginary plane longitudinally bisecting the divot tool body. The intersection of the plate with the divot tool body defines the longitudinal axis of lateral symmetry. The tool includes a pair of longitudinally directed legs at one of its ends and a magnet embedded in the other of its ends. The narrow strip is bent transversely to define a raised hump located between the ends. This hump is oriented perpendicular to the longitudinal axis of lateral symmetry.

The strip from which the divot tool is fabricated may be formed of aluminum that is stamped and permanently deformed to define the hump. The hump faces convex upwardly and has an underside that forms a concave downwardly facing groove. A circular opening is die cut into the end of the narrow strip opposite the end from which the legs project. The magnet is a permanent magnet configured as a disc and having a thickness equal to the thickness of the aluminum strip.

The invention may be described with greater clarity and particularity by reference to the accompanying drawings.

DESCRIPTION OF THE EMBODIMENTS

Figure 1:
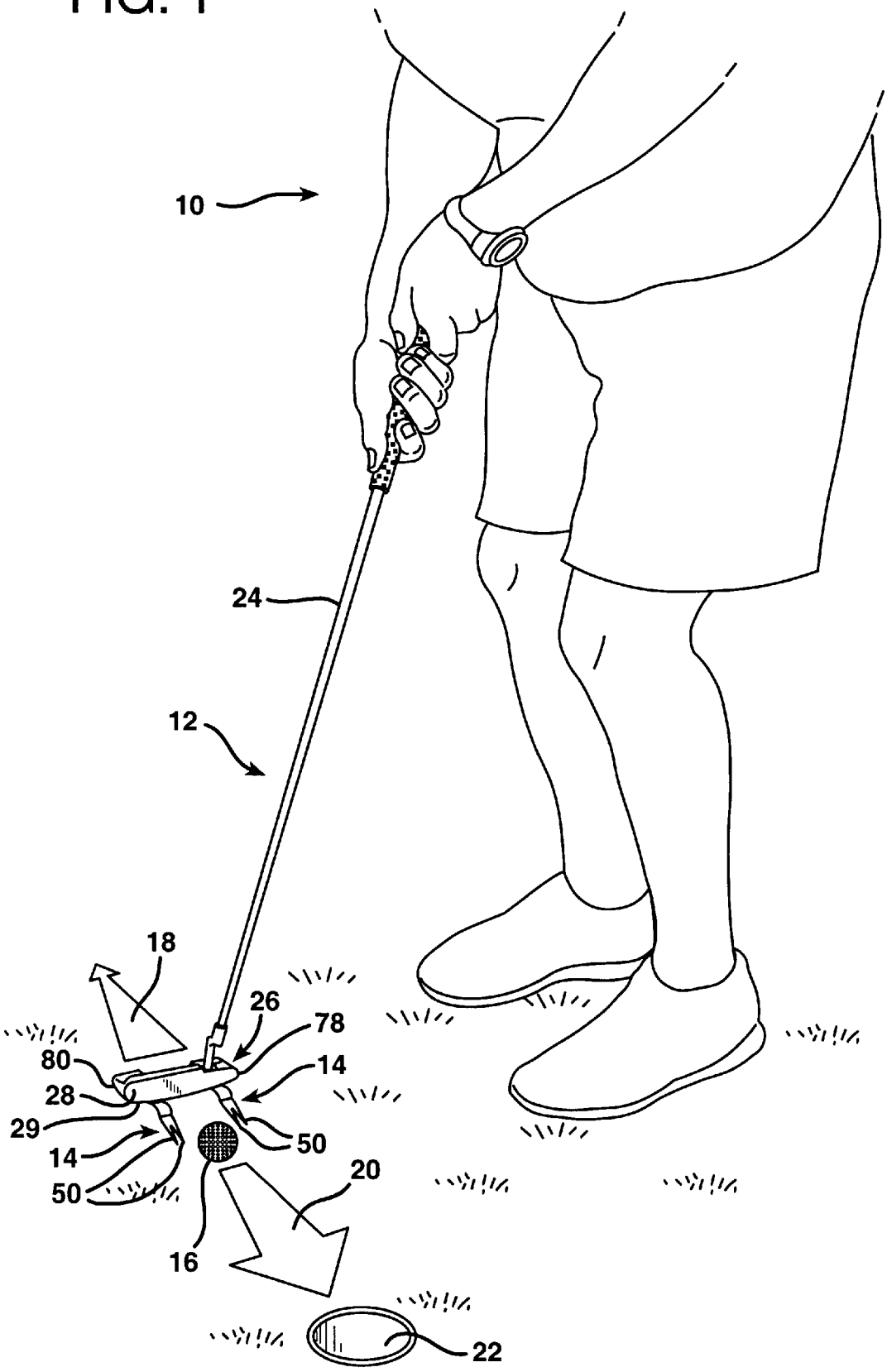
FIG. 1 is a perspective view illustrating one combination of a golf putter and a pair of divot tools according to the invention.

FIG. 1 illustrates a golfer indicated generally at 10 utilizing a golf putter 12 in combination with a pair of identical golf divot repair tools 14 according to the invention as a practice aid for golf putting. The golfer 10 observes the alignment of the divot repair tools 14 relative to a golf ball 16 as the golfer first moves the golf putter in a backstroke, indicated by the directional arrow 18, and then forwardly in an actual putting stroke, as indicated by the directional arrow 20. By utilizing the golf divot repair tools 14 for purposes of alignment in combination with the golf putter 12, the golfer is able to more precisely execute a proper backstroke 18 and putting stroke 20 so that the golf ball 16 will drop into the cup 22, even from a far greater distance than is indicated in FIG. 1.

The golf putter 12 has a shaft 24, which may be formed of wood, metal, or some plastic composite material. The club head 26 of the golf putter 12 must be formed of some material that is attracted by magnetism, typically steel.

The configuration of the golf club head 26 is best illustrated in the detail drawings of FIGS. 2–7. The golf club head 26 has flat, front ball-impact face 28, and a sole 30 extending rearwardly from the front ball-impact face 28. The golf club head 26 also has a back including a central region 32 that rises sharply upwardly from the sole 30 at a linear demarcation 34 therefrom. The central region 32 forms an angle of at least forth-five degrees relative to the sole 30, and more typically is perpendicular thereto.

The central region 32 defines a shelf 36 that has a flat surface oriented perpendicular to the front face 28 and parallel to the sole 30. The central region 32 also forms a rear abutment face 38 that extends up from the planar shelf 36 at a linear demarcation 40 therewith that is parallel to the ball-impact face 28. The rear abutment face 38 extends at an angle of at least forty-five degrees relative to the shelf 36, but is preferably perpendicular thereto, as illustrated.

Figure 11:
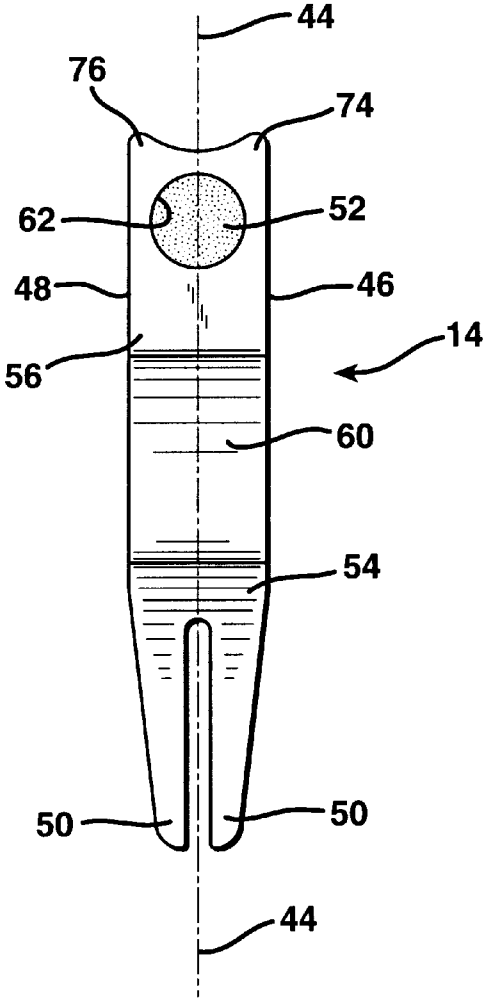
FIG. 11 is a bottom plan view of the divot repair tool of FIG. 9.
Figure 10:
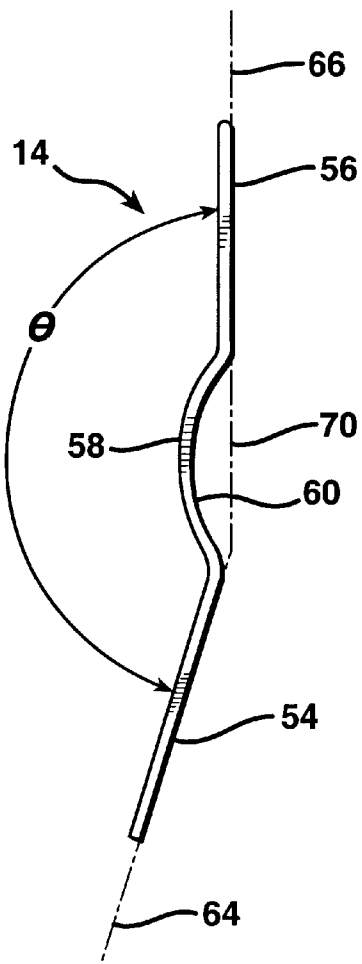
FIG. 10 is a side elevational view of the divot repair tool of FIG. 9.
Figure 9:
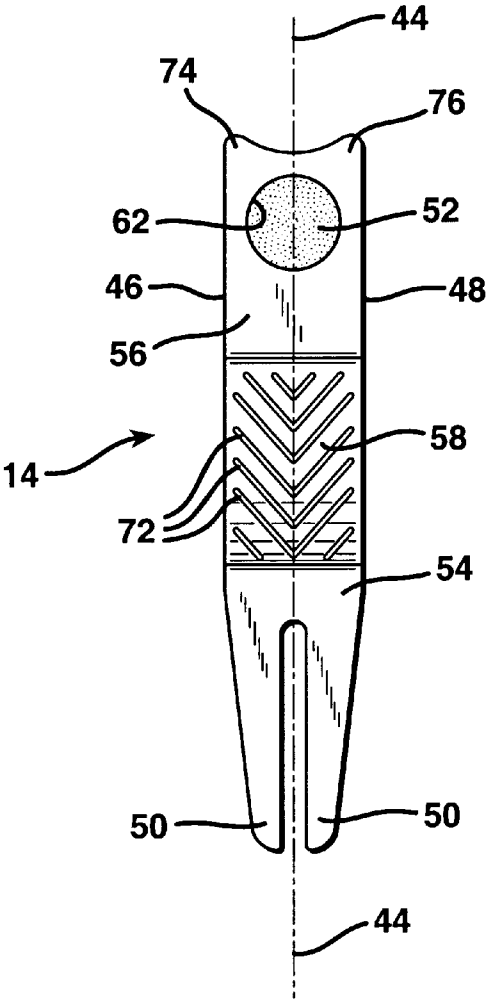
FIG. 9 is a top plan detail showing the divot repair tool of the invention in isolation.

The structure of each golf divot repair tool 14 is best illustrated in the isolated views of FIGS. 9, 10, and 11. As shown in those drawing figures, the golf divot repair tool 14 is formed of a thin, narrow strip of material, such as aluminum, which is magnetically insensitive. The aluminum strip forms a body 42 which may be between about eight and ten centimeters in length overall. The tool body 42 has opposing ends 54 and 56 and includes a pair of longitudinally directed legs 50 at one of its ends, the end 54, and a magnet 52 embedded in the other of its ends, the end 56. The end 56 of the divot tool 14 in which the magnet 52 is embedded is configured to form a concave indentation that defines a pair of laterally separated horns 74 and 76, as illustrated in FIGS. 9 and 11.

The body 42 is of a uniform thickness throughout. The body 42 may, for example, have a thickness of about 1.2 centimeters and a width of about 1.6 centimeters throughout most of its length. The structure of the divot repair tool 14 is symmetrical about a straight, longitudinal axis of lateral symmetry indicated at 44 is FIGS. 8 and 10. That is, the axis of symmetry 44 may be considered to be the alignment of an imaginary vertical plane that bisects the tool 14 longitudinally midway between its straight, lateral side edges 46 and 48. The portions of the divot repair tool 14 on either side of the longitudinal axis of symmetry 44 are mirror images of each other, as illustrated in FIGS. 9 and 11.

As best illustrated in FIG. 9, the narrow aluminum strip forming the golf divot repair tool 14 is bent transversely to define a raised hump 58 that is located between the ends 54 and 56. The hump 58 is oriented perpendicular to the longitudinal axis of lateral symmetry 44. That is the hump 58 has a uniform cross section between the opposing side edges 46 and 48 of the tool body 42 and extends in perpendicular alignment relative to the longitudinal axis of lateral symmetry 44.

Figure 8:
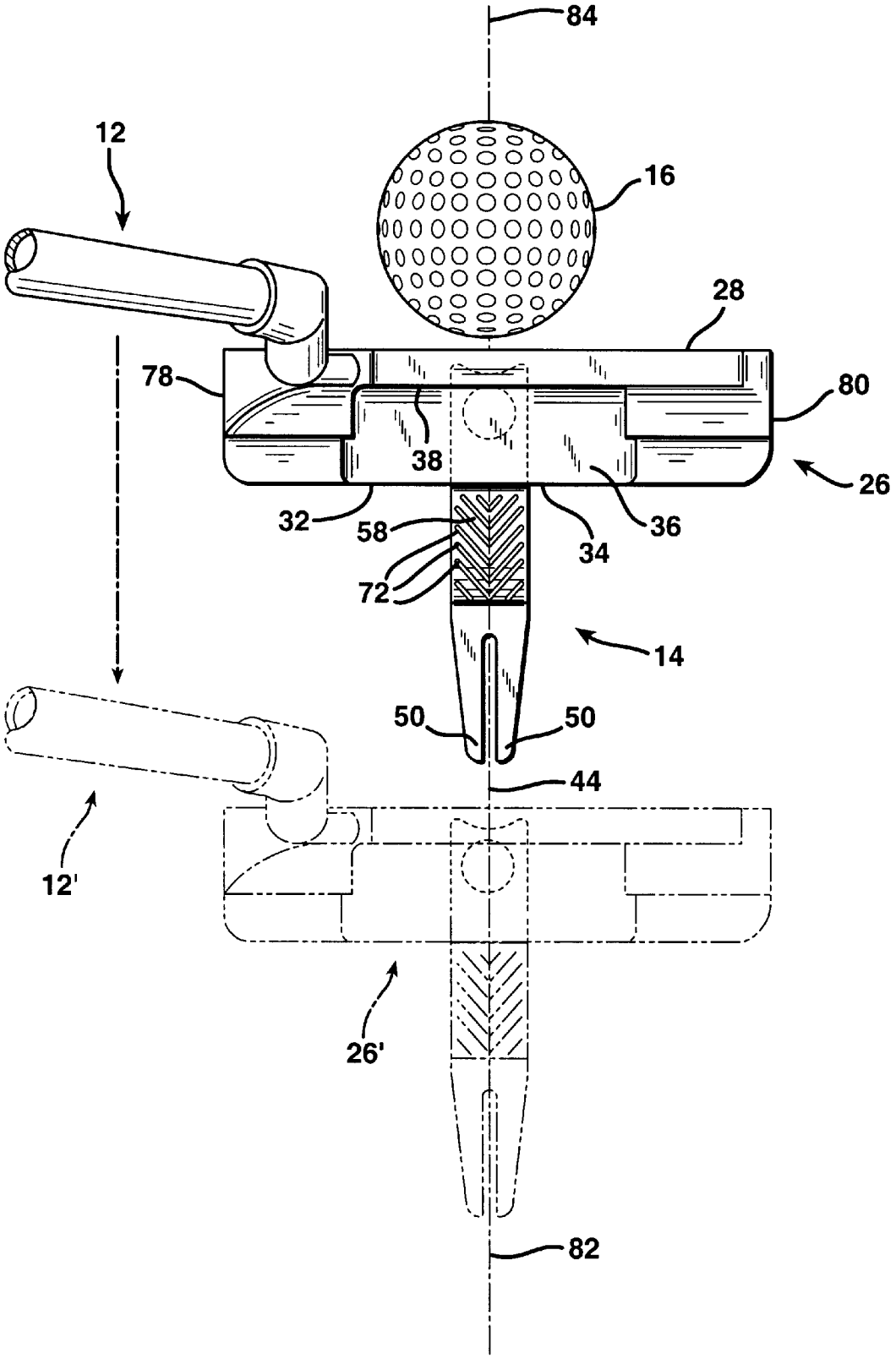
FIG. 8 is a top plan detail illustrating the combination of the golf putter club head and golf divot repair tool of FIG. 7 in still another alternative arrangement.

The aluminum strip forming the body 42 is stamped from a sheet of aluminum and is permanently deformed to define the hump 58. As illustrated in FIGS. 8–10, the hump 58 faces convex upwardly and has an underside formed as a concave downwardly facing groove 60. A circular opening 62 is die cut into the end 56 of the strip forming the body 42. The magnet 52 is a permanent magnet configured as a disc and having a thickness equal to the thickness of the aluminum strip forming the tool body 42. As a result, the opposing circular faces of the disc-shaped magnet 52 reside, respectively, in the planes of the opposing surfaces of the strip of the body 42 forming the end 56 thereof. Preferably, the magnet 52 is about 11.5 millimeters in diameter and has a thickness equal to the thickness of the metal strip forming the body, which is 1.2 millimeters thick.

The hump 58 extends longitudinally a distance of about two centimeters and lies between the end 54 of the body 42 at which the legs 50 are formed, and the end 56 of the body 42 in which the circular opening 62 is defined. Each of the ends 54 and 56 of the strip forming the body 42 resides in a separate plane 64 and 66, respectively. As illustrated in FIG. 10, the planes 64 and 66 in which the ends 54 and 56 of the strip forming the body 42 reside are oriented upwardly from each other at an obtuse angle $\theta$ of between about one hundred fifty and about one hundred sixty-five degrees to each other. The groove 60 has a depth of about four millimeters as measured from an imaginary line 70 that spans the edges of the groove 60, as shown in FIG. 9.

As best shown in FIG. 8, a plurality of chevron-shaped, traction-enhancing ribs 72 are stamped onto the convex outwardly facing surface of the hump 58. The ribs 72 serve to enhance traction between the thumb of a user and the outwardly facing surface of the hump 58 when the divot repair tool 14 is employed to spruce up golf green or fairway surfaces. The inside surface of the user's index finger fits comfortably against the concave surface of the groove 60, while the user's thumb bears against the convex surface of the hump 58 when the divot repair tool 14 is employed to spruce up crushed areas of grass on a golf green. By forming the tool 14 with a concave recess in its back side, the user is able to operate the tool at only a small, acute angle relative to the course surface being repaired.

Figure 6:
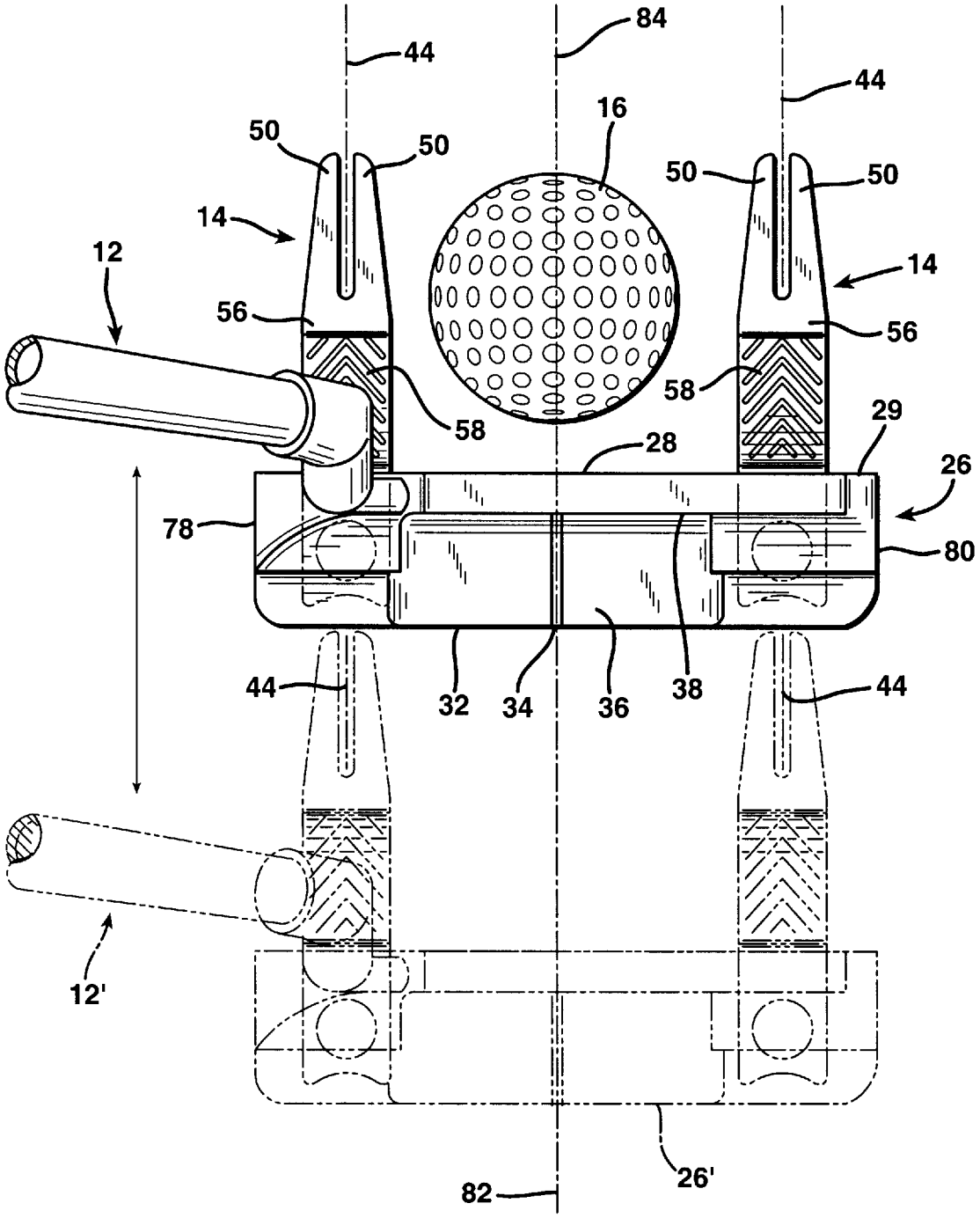
FIG. 6 is a top plan detail illustrating use of a pair of divot tools with a putter as shown in FIG. 1.

FIGS. 1 through 8 illustrate the use of the divot repair tool 14 is combination with the golf putter 12. FIGS. 1 and 6 illustrate use of a pair of divot repair tools 14 in combination with the golf putter 12 as a practice aid. As shown in those drawing figures, one of the divot repair tools 14 is positioned with the end 56 thereof in contact with the sole 30 proximate the heel 78 of the golf club head 26. The other divot repair tool 14 is located at the opposite end of the golf club head 26 proximate the toe 80 thereof. The end 56 of that golf divot repair tool 14 is likewise in contact with the downwardly facing sole 30 of the golf club head 26. Both of the divot tools 14 are pushed longitudinally rearwardly until the humps 58 thereof reside in abutment against the linear edge transition 29 between the flat ball-impact face 28 and the sole 30 of the golf club head 26. Since the alignment of each of the humps 58 is perpendicular to the longitudinal axis of lateral symmetry 44 of each of the golf divot repair tools 14, the longitudinal axes of lateral symmetry of both of the golf divot repair tools 14 are perpendicular to the front ball-impact face 28 of the golf club putter head 26, as best illustrated in FIG. 6. The legs 50 of both divot repair tools 14 thereby project forwardly from the ball-impact face 28 as illustrated.

The alignment of both of the golf divot repair tools 14 aids a golfer in moving the putter 12 straight to the rear in a backswing position, indicated in phantom at 12' in FIG. 6, so that the putter impact face 28 remains perpendicular to the path of backswing movement, indicated at 82 in FIG. 6. The forwardly projecting legs 50 of the golf divot repair tools 14 provide visual indicia to the golfer 10 that assist the golfer 10 in maintaining a perfect, straight linear backstroke path 82, so that the forward path of movement of the club 26, indicated at 84 in FIG. 6, passes through the center of the golf ball 16 and directly along the intended path of travel of the ball 16. Moreover, by using a pair of divot tools 14, the golfer 10 is provided with guides at both the heel 78 and the toe 80 of the golf club 12. The pair of tools 14 assist the golfer in maintaining the ball 16 aligned with the center of the ball-impact face 28. As a result, the forward path of travel 84 of the club head 26 brings the club face 28 into contact with the ball 16 at the "sweet spot", which is a the exact center of the face 28, and not off center toward either the heel 78 or the toe 80 of the club head 26.

The golfer 10 can use one or more of the golf divot repair tools 14 magnetically attached to the club head 26 as a golf practice aid in practicing putting toward an imaginary cup while awaiting his or her turn to shoot at a putting green. The golf divot repair tools 14 are held firmly to the sole of the golf club putter head 26 by the force of magnetic attraction of the magnets 52 to the steel golf club head 26. The forwardly projecting legs 50 of the divot repair tools 14 further aid the golfer 10 in that the eyes of the golfer 10 are more likely to remain focused directly on the ball 16 as the ball-impact face 28 approaches the ball 16 to avoid hitting the ball 16 with either of the golf divot repair tools 14. FIG. 6 illustrates at 26' the position of the golf club head 26 at the extreme end of a short backstroke, directly behind the ball 16.

Figure 7:
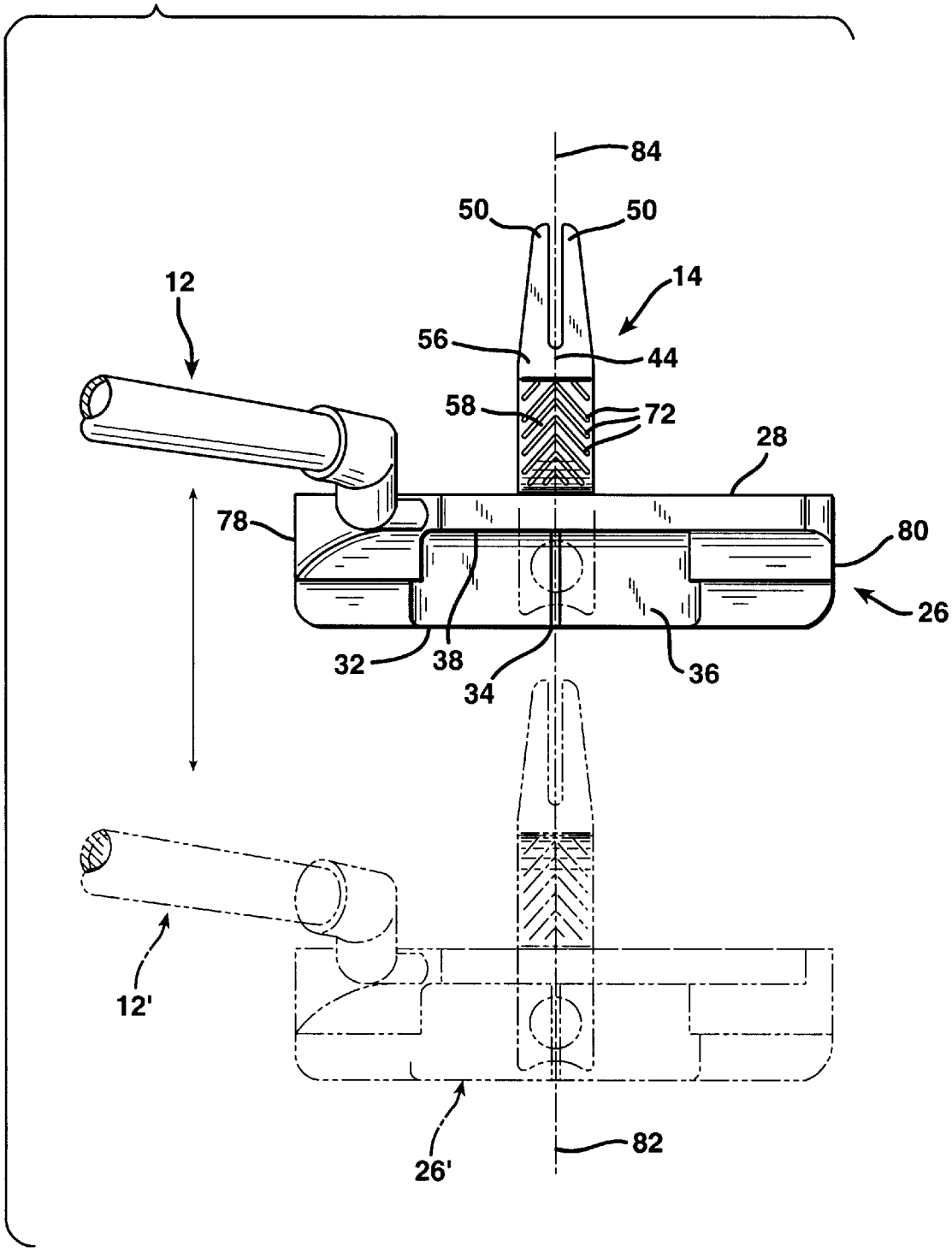
FIG. 7 is top plan detail illustrating a combination of a single golf divot repair tool and a golf putter in an alternative manner.

The golf putter 12 may also be used in combination with a single golf divot repair tool 14 projecting forwardly from the ball-impact face 28 to practice a putting approach without actually striking a golf ball. As shown in FIG. 7, a single golf divot repair tool 14 may be utilized in much the same manner as the pair of golf divot repair tools 14 employed in the combination of FIGS. 1 and 6. In the embodiment of FIG. 7, the single golf divot repair tool 14 utilized is positioned with its end 56 in which the magnet 52 is embedded located directly beneath the center of the ball-impact face 28 and in contact with the sole 30 of the golf club head 26.

The hump 58 of the golf divot repair tool 14 is aligned perpendicular to the longitudinal axis of lateral symmetry 44 and is pressed into abutment against the lower edge 29 of the ball-impact face 28. The edge 29 forms the demarcation between the face 28 and the sole 30 of the golf club head 26. The magnetic force of attraction of the magnet 52 to the golf club head 26 holds the golf divot repair tool 14 tightly to the golf club head 26 with the legs 50 of the divot repair tool 14 projecting straight out from the ball-impact face 28.

The alignment of the golf divot repair tool 14 relative to the ball-impact face 28 aids the golfer in executing a proper putting backstroke in which the golf club head 26 is drawn straight back from the position of contact with an imaginary golf ball to the phantom position indicated at 26' in FIG. 7. The forward projection of the legs 50 of the tool 14 further aid the golfer 10 in bringing the club head 26 sharply forward in a proper reverse, forward stroke direction 84 relative to the backswing path 82. The golf divot repair tool 14, when magnetically coupled to the club head 26 to project forwardly from the ball-impact face 28, provides the golfer with a readily observable visual aid to promote development of a proper putting backswing and forward putting stroke.

FIG. 8 illustrates still another manner in which a single divot repair tool 14 may be coupled to the putter club head 26. In the arrangement shown in FIG. 8, the position of the divot repair tool 14 is reversed from that shown in FIG. 7. The golf divot repair tool 14 is held against the sole 30 of the putter club head 26 by magnetic attraction between the magnet 52 and the club head 26 with the end 56 of the tool 14 drawn into contact with the sole 30, as in the combination of FIG. 7. However, in FIG. 8, the position of the tool 14 is reversed one hundred eighty degrees from the position shown in FIG. 7, so that the raised, transverse hump structure 58 of the tool 14 resides in abutment with the central region 32 of the back of the club head 26. The legs 50 of the divot repair tool thereby project rearwardly from the central region 34 of the back of the club head 26 in a direction away from the ball-impact face 28.

The divot repair tool 48 is aligned in FIG. 8 so that the longitudinal axis of lateral symmetry 44 of the repair tool 14 lies perpendicular to the front, ball-impact face 28 of the club head 26. The legs 50 are directed rearwardly, thus providing the golfer 10 with a convenient indicia for bringing the club head 26 straight back from the ball 16 in the proper backswing path 82 that is in alignment with and directly opposite to the intended forward path of travel 84 of the ball 16. Since the alignment of the hump 58 is perpendicular to the axis of lateral symmetry 44, perpendicular alignment of the axis of lateral symmetry 44 of the tool 14 relative to the ball-impact face 28 is assured, because the central region 34 of the back of the club head 26 is parallel to the ball-impact face 28.

Figure 2:
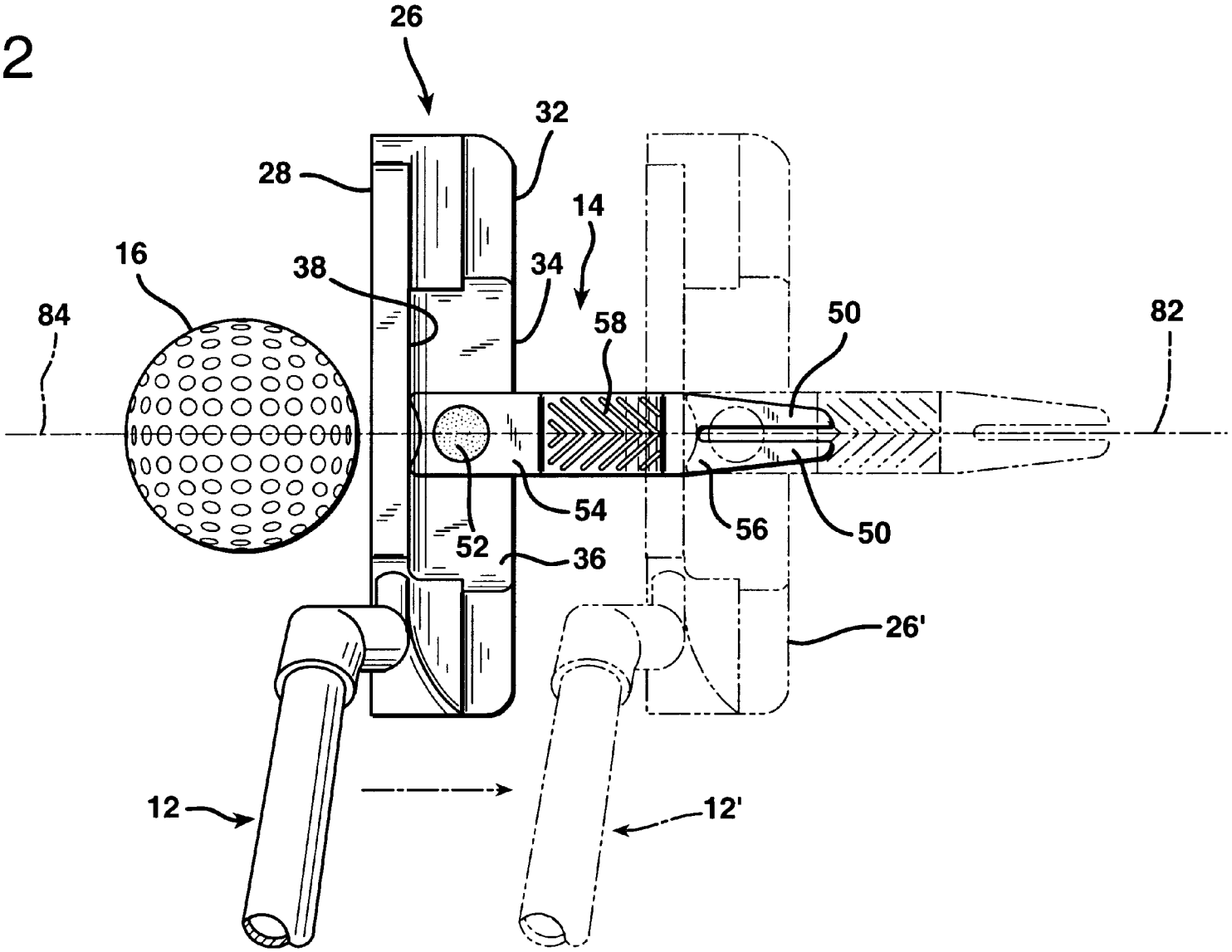
FIG. 2 is a top plan detail illustrating the combination of a golf putter club head with a single divot tool according to the invention as aligned and moving in a proper backswing.
Figure 4:
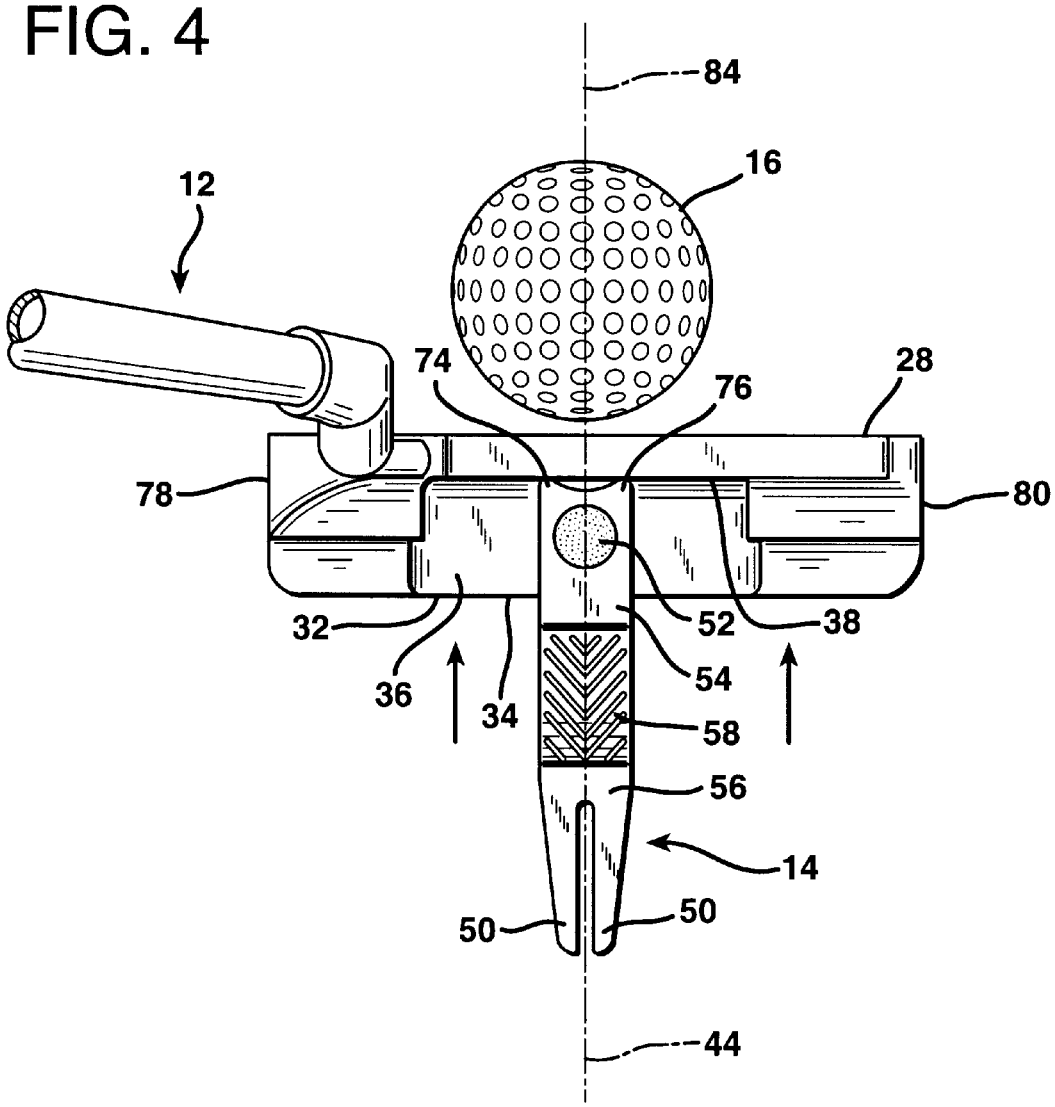
FIG. 4 is a top plan detail illustrating a proper forward swing of the putter head following the proper backswing of FIG. 2.
Figure 5:
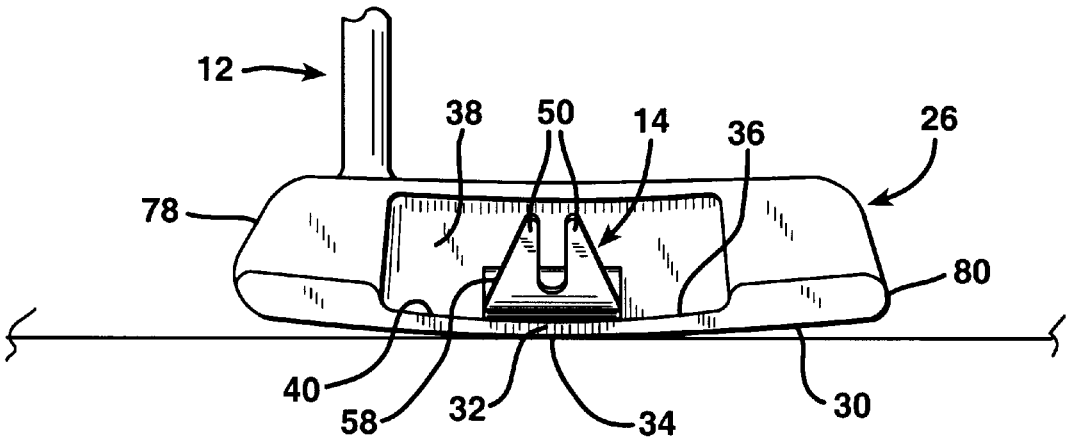
FIG. 5 is a rear elevational detail showing the putter head and divot tool positioned as in FIG. 4.

FIGS. 2 and 4 illustrate still another manner in which the golf putter 12 and golf divot repair tool 14 may be combined together when the club head 26 is configured in such a way as to define the shelf 36 and rear abutment face 38 in the embodiment shown. In the arrangement of FIGS. 2 and 4, the end 56 of the tool 14 is positioned atop the shelf 36, rather than in contact with the sole 34 of the golf club head 26. The repair tool 14 is held against the shelf 36 of the club head 26 by magnetic attraction between the magnet 52 and the club head 26 with the horns 74 and 76 located at the lateral extremities of the end 56 of the tool 14 in contact with the rear abutment face 38 at the linear demarcation 40 between the shelf 36 and the rear abutment face 38. The legs 50 of the divot repair tool 14 thereby project rearwardly from the shelf 36 in a direction away from the ball-impact face 28 and in an alignment relative thereto so that the axis of lateral symmetry 44 is perpendicular to the ball-impact face 28.

With the divot tool 14 magnetically coupled to the putter club head 26 atop the shelf 36, as illustrated in FIG. 4, the golfer 10 can execute a backstroke, bringing the club head 26 straight back long the path 82, and actually putt the ball 16 forward along the path 84 that lies one hundred eighty degrees opposite the proper backswing path 82. When the tool 14 is magnetically coupled to the putter club head 26 atop the shelf 36, as depicted in FIGS. 4 and 2, it does not interfere in any way with the proper execution of an actual putt in which the ball-impact face 28 of the club head 26 strikes the ball 16. The orientation of the tool 14 such that its axis of lateral symmetry 44 is oriented perpendicular to the ball-impact face 28 of the club head 26, provides the golfer 10 with a very convenient visual indicia that allows visual observation of an improper backstroke, which is illustrated in FIG. 3.

Figure 3:
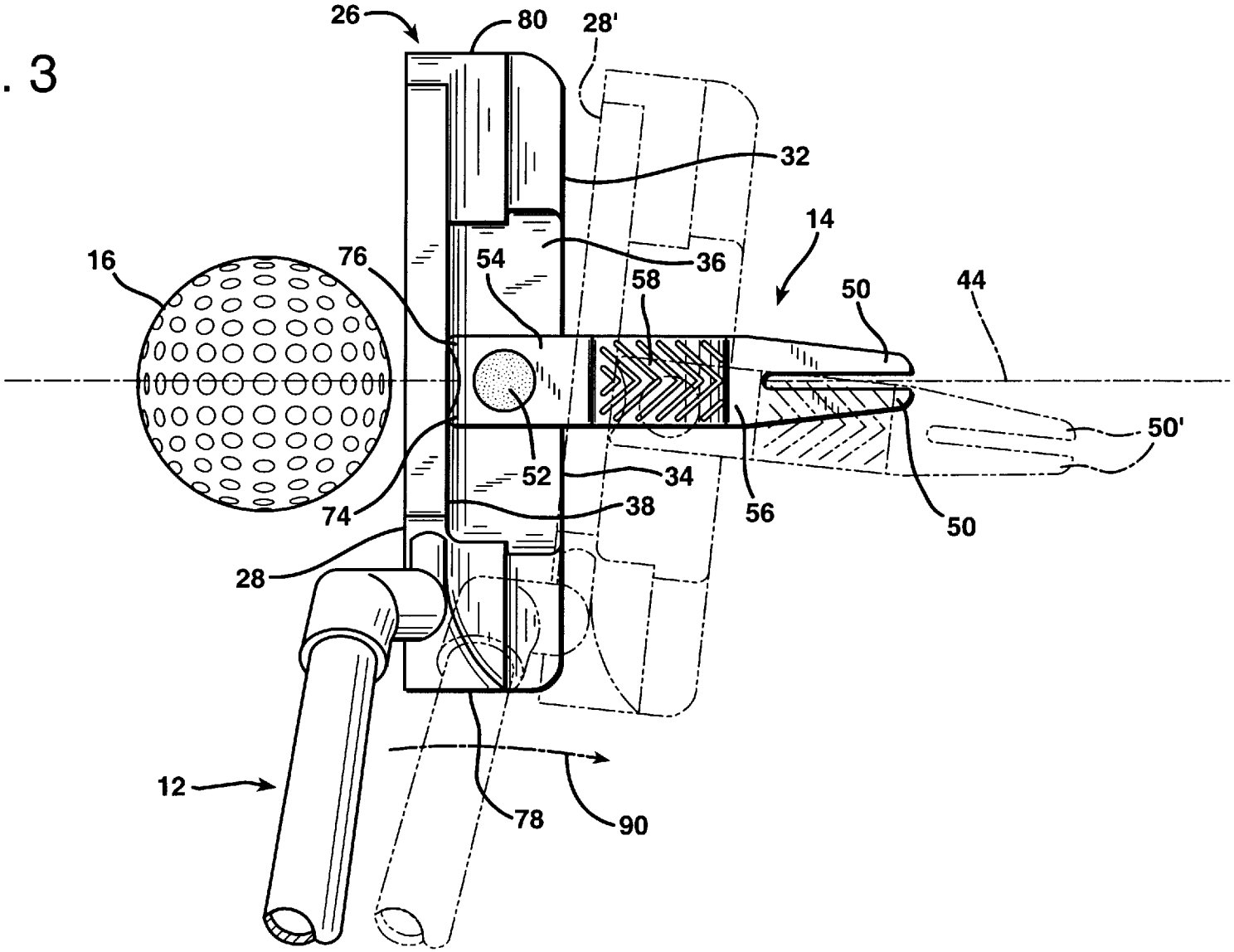
FIG. 3 is top plan detail illustrating the manner in which the divot repair tool will indicate an improper backswing to the golfer.

If the golfer 10 brings the putter club head 26 rearwardly other than along the proper backswing path 82, as, for example, along an arcuate path indicated at 90 in FIG. 3, the departure of movement of the club head 26 from the proper path 82 can be readily seen by visually observing the alignment that the tool legs 50 assume, which is indicated in phantom at 50' in FIG. 3. While the golfer 10 may not readily detect the misalignment of the ball-impact face, indicated at 28' in FIG. 3, the misaligned positions of the tool legs 50' is more readily apparent. Thus, the golfer 10 is forewarned that correction is required in order to execute a proper backswing of the putter 12.

As can be seen from the drawing figures, the tool 14 of the invention may be combined with a golf putter 12 in a variety of ways to serve as a putting practice aid. Moreover, due to the small size of the tool 14, and the ease of magnetic attachment to and detachment from the club head 26, the tool 14 can be combined with and separated from the putter 12 on a moments notice. Thus, the golfer 10 is provided with a practice aid that can be utilized when the golfer 10 has only a very short period of time within which to practice.

Moreover, due to the configuration of the tool 14 with the hump 58 oriented perpendicular to the longitudinal axis of lateral symmetry 44, and with the tips of the horns 72 and 74 aligned along a line perpendicular to the axis of lateral symmetry 44, the tool 14 is self-aligning when magnetically coupled to the club head 26. That is, when magnetically coupled to the sole of the club head 26, alignment of the tool 14 perpendicular to the ball-impact face 28 is assured by the abutment of the hump 58 against the lower edge 29 of the ball-impact face 28 or against the lower edge of the rear central region 34 of the back of the club head 26. Alternatively, the tool 14 may be aligned to project perpendicular to the ball-impact face 28 by the abutment of the horns 72 and 74 against the rear abutment face 38 for golf club head 26 configured as shown.

Undoubtedly, numerous variations and modifications of the invention will become readily apparent to the manufacturers of golf accessories, and to golfers themselves. For example, the position of the tool 14 relative to the club head 26 may be adjusted to suite the idiosyncrasies of execution of putts by particular golfers. Some golfers may execute backswings in such a manner that it is more appropriate for the axis of lateral symmetry 44 of the tool 14 to be aligned to one side of the other of the backswing path 82, which is normally considered to be the proper backswing path. In such a case the golfer merely twists the tool 14 slightly from the positions shown in FIGS. 4, 6, 7, or 8 slightly to one side or the other as appropriate relative to the normal, proper backswing bath 82.

Also, the construction of the divot tool 14 can be varied without departing from the scope of the invention. For example, the tool 14 does not necessarily have to be formed with a rounded hump 58, as illustrated, but could be formed with a stamped rib or a pair of dimples oriented perpendicular to the longitudinal axis of lateral symmetry 44 instead. Such a rib would serve as a stop in the same manner as the hump 58 to allow the golfer 10 to align the tool 14 perpendicular to the ball-impact face 28 of the club 26 consistently each and every time. Accordingly, the scope of the invention should not be construed as limited to the specific embodiments of the invention depicted and described.

What is claimed is:

1. A golf putting training aid comprising in combination:

a golf putter having a club head formed of a material attracted by magnetism and having a flat front ball-impact face, a sole extending rearwardly from said front ball-impact face, and a back including a central region that rises sharply upwardly from said sole at a linear demarcation therefrom and said central region joins said sole at an angle of at least forty-five degrees relative to said sole, and a thin golf divot repair tool with a longitudinally elongated body defining a straight longitudinal axis of lateral symmetry and having opposing ends and including a pair of longitudinally directed legs at one of said ends, a magnet embedded in said other of said ends, and a raised transverse structure located between said ends and oriented perpendicular to said longitudinal axis of lateral symmetry, and said golf divot repair tool is held against said club head by magnetic attraction between said magnet and said club head.

2. A golf putting training aid according to claim 1 wherein said golf divot repair tool is held against said sole of said club head by magnetic attraction between said magnet and said club head with said raised, transverse structure of said tool positioned against said central region of said back of said club head whereby said legs of said divot repair tool project rearwardly from said central region of said back of said club head in a direction away from said ball-impact face.

3. A golf putting training aid according to claim 2 wherein said divot repair tool is aligned so that said longitudinal axis of lateral symmetry of said repair tool lies perpendicular to said front ball-impact face of said club head.

4. A golf putting training aid according to claim 1 wherein said golf divot repair tool is held against said sole of said club head by magnetic attraction between said magnet and said club head with said raised, transverse structure of said tool positioned against said front ball-impact face of said club head, whereby said legs of said divot repair tool project forwardly from said front ball-impact face of said club head in a direction away from said back of said club head.

5. A golf putting training aid according to claim 4 wherein said divot repair tool is aligned so that said longitudinal axis of lateral symmetry of said repair tool lies perpendicular to said front ball-impact face of said club head.

6. A golf putting training aid according to claim 1 wherein said divot repair tool body is formed of a stamped strip of nonferrous metal of uniform thickness throughout, and said raised, transverse structure is formed as a hump in said stamped strip.

7. A golf putting training aid according to claim 6 further comprising a circular opening cut into said other of said ends of said elongated body, and said magnet is formed as a disc set into said opening and permanently secured thereto, and said disc has a thickness equal to the thickness of said strip of nonferrous metal.

8. A golf putting training aid comprising in combination:

a golf putter having a club head formed of a material attracted by magnetism and having a flat, front ball-impact face, a sole extending rearwardly from said front ball-impact face and oriented perpendicular thereto, and a back including a central region defining a planar shelf with a flat surface oriented perpendicular to said front face and parallel to said sole and a rear abutment face extending up from said planar shelf at a linear demarcation therewith that is parallel to said ball-impact face and said rear abutment face extends at an angle of at least fortyfive degrees relative to said shelf, and a thin golf divot repair tool with a longitudinally elongated body defining a straight, longitudinal axis of lateral symmetry and having opposing ends and including a pair of longitudinally directed legs at one of said ends and a magnet embedded in said other of said ends, and said golf divot repair tool is held against said shelf of said club head by magnetic attraction between said magnet and said club head with said end of said divot repair tool bearing said magnet residing in contact with said rear abutment face at said linear demarcation so that said legs of said divot repair tool project rearwardly from said shelf in a direction away from said ball-impact face.

9. A golf putting training aid according to claim 8 wherein said body of said divot repair tool is formed by a strip of magnetically insensitive metal of uniform thickness throughout, and said other of said ends of said body is configured with a concave recess defined therein that defines a pair of laterally separated horns, and said horns both contact said rear abutment face of said club.

10. A golf putting training aid comprising in combination:

a golf putter having a club head formed of a material attracted by magnetism and having a flat, front ball-impact face, a sole extending rearwardly from said ball-impact face and oriented perpendicular thereto with a straight, linear edge transition between said impact face and said sole, and at least one thin golf divot repair tool with a longitudinally elongated body defining a straight, longitudinal axis of lateral symmetry and having opposing ends and including a pair of longitudinally directed legs at one of said ends, a magnet embedded in the other of said ends, and a raised, transverse structure located between said ends and oriented perpendicular to said longitudinal axis of lateral symmetry, and said golf divot repair tool is held against said sole of said club head by magnetic attraction between said magnet and said club head with said raised transverse structure of said tool residing in abutment against said straight linear edge transition, whereby said legs of said at least one divot repair tool project forwardly from said ball-impact face.

11. A golf putting training aid according to claim 10 further comprising a pair of said divot tools as aforesaid both magnetically adhering to said club head as aforesaid at laterally spaced locations from each other.

12. A golf putting training aid according to claim 11 wherein said golf divot tools are identical to each other in structure.

13. A golf divot repair tool formed as a thin, narrow strip of magnetically insensitive material of uniform thickness throughout having a longitudinally elongated body defining a straight longitudinal axis of lateral symmetry and having opposing ends and including a pair of longitudinally directed legs at one of said ends and a magnet embedded in the other of said ends, and said narrow strip is bent transversely to define a raised hump located between said ends and oriented perpendicular to said longitudinal axis of lateral symmetry.

14. A golf divot repair tool according to claim 13 wherein said strip is formed of aluminum that is stamped and permanently deformed to define said hump, and said hump faces convex upwardly, whereby said strip forms a concave downwardly facing groove opposite said hump.

15. A golf divot repair tool according to claim 14 wherein a circular opening is die cut into said other of said ends of said narrow strip and said magnet is a permanent magnet configured as a disc having a thickness equal to said thickness of said aluminum strip.

16. A golf putting training aid according to claim 14 wherein said strip is between about eight and ten centimeters in length overall and said hump extends longitudinally a distance of about two centimeters and said groove has a depth of about four millimeters.

17. A golf divot tool according to claim 16 wherein each of said ends of said strip resides in a separate plane, and said planes in which said ends of said strip reside are oriented upwardly from each other at an obtuse angle of between about one hundred fifty and about one hundred sixty-five degrees relative to each other.

18. A golf putting training aid according to claim 16 wherein a plurality of traction-enhancing ribs are stamped onto said convex upwardly facing hump.

19. A golf putting training aid according to claim 13 wherein said other end of said strip is configured with a concave recess formed in its extremity to define a pair of laterally separated horns.

* * * * *